United States Patent [19]

Bucchianeri

[11] Patent Number: 4,474,590

[45] **Date of Patent: * Oct. 2, 1984**

[54] PROCESS FOR SEPARATION OF GAS MIXTURE

[75] Inventor: Bernard A. Bucchianeri, Monongahela, Pa.

[73] Assignee: United States Steel Corporation, Pittsburgh, Pa.

[ * ] Notice: The portion of the term of this patent subsequent to Nov. 8, 2000 has been disclaimed.

[21] Appl. No.: 500,726

[22] Filed: Jun. 3, 1983

Related U.S. Application Data

[63] Continuation-in-part of Ser. No. 298,052, Aug. 31, 1981, Pat. No. 4,414,007.

[51] Int. Cl.[3] ..... F25J 3/02

[52] U.S. Cl. ..... 62/12; 62/18; 62/38

[58] Field of Search ..... 62/11, 12–15, 62/18, 38, 39; 55/80–82

[56] References Cited

U.S. PATENT DOCUMENTS 3,102,015 8/1963 Thumm et al. ..... 62/13

*Primary Examiner*—Frank Sever

*Attorney, Agent, or Firm*—W. Gary Goodson

[57] ABSTRACT

A process for the purification of the low-boiling constituents of a compresed gas mixture, such as a mixture comprising a carbonaceous gas, by cooling to low temperatures in cyclical alternated regenerators to condense high-boiling constituents of the gas mixture comprising (1) passing the gas mixture through a first regenerator from the warm end to the cold end of the same to cool the gas mixture and to condense the high-boiling constituents of the mixture thereby producing a purified gas stream; (2) passing a scavenging gas which is at a lower pressure than said gas mixture in the first regenerator through a second regenerator from the cold end to the warm end of the same to clean this second regenerator and to re-evaporate the high-boiling constituents, (3) passing at least part of the purified gas stream through a third regenerator from the cold end to the warm end of the same to re-cool this third regenerator, preferably to the temperature of the first regenerator, and (4) compressing and recycling at least part of the scavenging gas which has passed through the second regenerator through the first regenerator from the warm end to the cold end and repeating the process as defined above.

26 Claims, 2 Drawing Figures

PROCESS FOR SEPARATION OF GAS MIXTURE

This application is a continuation-in-part of co-pending application Ser. No. 298,052, filed Aug. 31, 1981, now U.S. Pat. No. 4,414,007.

FIELD OF THE INVENTION

This invention relates generally to processes for separating gas mixtures and, more specifically, to purifying compressed gas mixtures by cooling to a low temperature in cyclical alternated regenerators to condense high-boiling constituents of the gas mixture. In a preferred embodiment, this invention relates to purifying coke-oven gas streams to produce a purified stream suitable for use, for example in a hydrogen production plant. The purified gas stream of this preferred embodiment is preferably composed of methane, carbon monoxide, hydrogen and nitrogen.

DESCRIPTION OF THE PRIOR ART

The use of pairs of filler-loaded, deep-cooled regenerators through which gas mixtures are alternatingly conducted in opposite directions or conducted in alternatingly opposite directions are generally known in the art. Uniformity of operation and a satisfactory removal of the impurities deposited from the gas mixture is their important requirement.

The operation of these regenerator pairs is based on the following principles.

The regenerators are charged with filler masses and initial gas mixtures are passed through a regenerator during a first step conducted at a relatively high pressure, and wherein the high-boiling constituents of the gas mixture are condensed onto the filler masses. During a second step, a scavenging gas is passed through this regenerator at a reduced pressure to remove the condensed high-boiling constituents from the regenerator. This scavenging gas is often used as fuel due to the impurities present. The purified gas stream from the first step is passed through the regenerator in a third step to thereby cool the third regenerator.

Considerable effort has been expended over many years in improving the efficiency and productivity of this method for separating of gas mixtures using regenerators. For example, U.S. Pat. No. 2,715,820, relates to a method for enabling the maintenance of satisfactory work of the regenerators, at a substantially equal pressure of the impure and of the purified gas, as well as the use of a low-pressure for the gas separation to thereby achieve economical operating conditions. U.S. Pat. No. 3,091,093 relates to a method for reducing the amount of scavenging gas necessary for cleansing the regenerator. One of the reasons for this latter invention is to achieve a higher concentration of separated substances. Each of these patents is hereby incorporated by reference.

One of the major problems that exists with the prior art regenerator system is that the scavenging gas in the process of cleaning the regenerators becomes contaminated with impurities. This usually results in a significant reduction in the production of pure gas. In the case wherein part of the purified gas stream from the first regenerator is utilized as a scavenging gas, a significant portion of the purified gas is unfit for certain uses. For example, when the purified gas stream is derived from coke-oven gas and comprises carbon monoxide, methane, hydrogen and nitrogen, the purified gas stream is a suitable feed for a hydrogen production plant. However, the contaminated gas stream that results from cleaning regenerators oridinarily is burned as a crude fuel because of the impurities present.

An additional problem with the prior art regenerator system is that when a compressor is utilized prior to the first regenerator in conjunction with a variable source of gas such as from coke ovens, the compressor experiences serious energy inefficiencies. In order to overcome these inefficiencies, it becomes necessary to recycle some of the compressed gas leaving the compressor and feed it back into the same compressor in order to maintain a relatively uniform rate of the gas going through the compressor.

Additionally, a variable source of gas causes inefficiencies in the operation of the regenerators, as well as inefficiencies in processes utilizing as a feed stream the purified gas stream leaving the regenerator system.

BRIEF DESCRIPTION OF THE INVENTION AND FIGURES

The invention described herein relates to a process for the purification of the low-boiling constituents of a compressed gas mixture by cooling to low temperatures in cyclical alternated regenerators to condense high-boiling constituents of the gas mixture comprising (1) passing the gas mixture through a first regenerator from the warm end to the cold end of the same to cool the gas mixture and to condense the high-boiling constituents of the mixture thereby producing a purified gas stream; (2) passing a scavenging gas which is at a lower pressure than said gas mixture in the first regenerator through a second regenerator from the cold end to the warm end of the same to clean this second regenerator and to re-evaporate the high-boiling constituents, (3) passing at least part of the purified gas stream through a third regenerator from the cold end to the warm end of the same to re-cool this third regenerator, preferably to the temperature of the first regenerator, and (4) compressing and recycling at least part of the scavenging gas which has passed through the second regenerator through the first regenerator from the warm end to the cold end and repeating the process as defined above, and wherein the scavenging gas which has passed through the second regenerator is very dilute in the high-boiling constituents. Preferably, the scavenging gas is obtained by expanding part of the purified gas stream. Additionally, it is preferred that the second regenerator comprises two separate regenerators; and part of the expanded purified gas stream from the first regenerator undergoes further pressure reduction and is passed through the regenerator the first of these two regenerators, which is kept at sufficiently low pressure to remove most of the high-boiling constituents; and wherein a different part of the expanded purified gas stream is passed through the second of these two regenerators to thereby remove substantially all of the balance of said high-boiling constituents.

By means of this invention, wherein the scavenging gas, or at least part of the scavenging gas is recycled through the regenerator system, it is now possible to increase the production of purified gas significantly with minimal additional cost. Since the purified gas stream is generally of considerably greater value than the gas stream containing impurities, this can amount to significant economic advantages.

Additionally, by means of a preferred embodiment of this invention, it is now possible to vary the amount of scavenging gas recycled to the first regenerator or to the compressor going into the first regenerator. Thus, where one has a variable source of a carbonaceous gas such as that obtained from coke ovens, the compressor, regenerators, or process utilizing a feed stream of the purified gas stream can operate much more efficiently by controlling the recycle such that a desired flow rate through one or all of these is obtained. For example, in the case of the compressor, it will now be possible to eliminate the recycle of compressed gas coming out of the compressor back into the feed gas going into the compressor. Obviously, this reduces a waste of energy and thereby results in a net savings for the process.

The invention described herein also includes the apparatus for carrying out the described processes.

DESCRIPTION OF THE PREFERRED EMBODIMENT(S)

Figure 1:
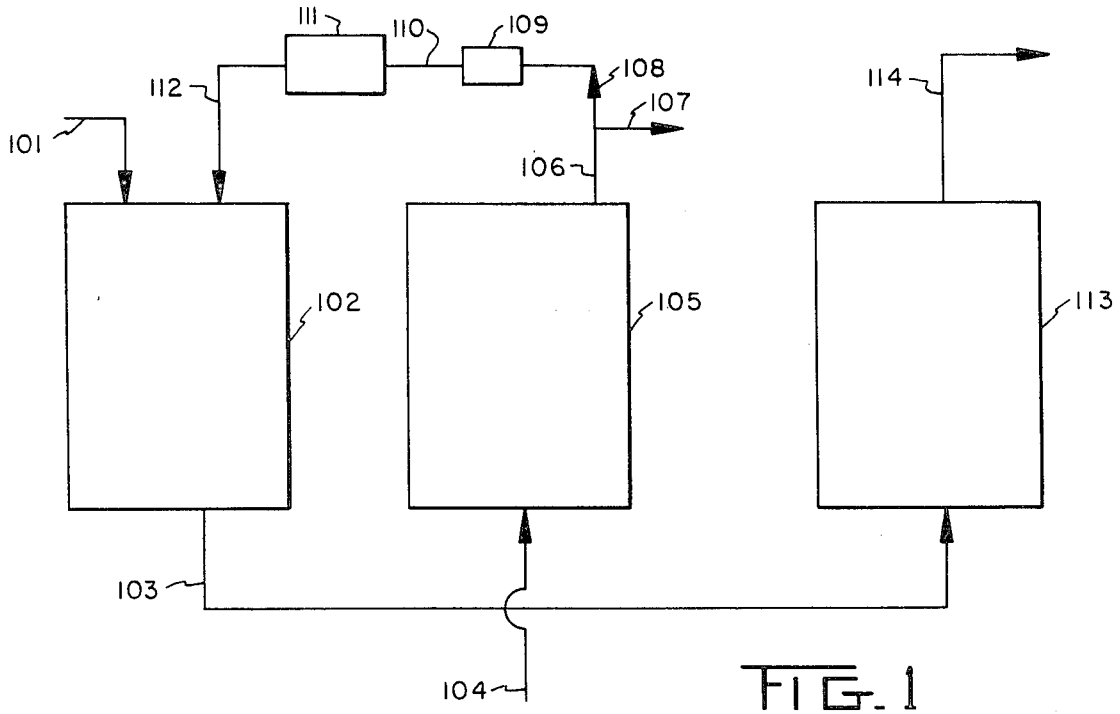
FIG. 1 is a flow diagram of a three cyclical regenerator system for the separation of gas mixtures.

In FIG. 1 crude pressurized gas such as coke-oven gas enters through line 101 into first regenerator 102. The temperature and pressure of the regenerator 102 are maintained at such a level that the desired high-boiling constituents of said gas mixture are condensed on the packing material in regenerator 102. Purified gas stream leaves regenerator 102 through line 103. A scavenging gas such as that obtained by expanding part of the purified gas stream from line 103 is passed through line 104 into second regenerator 105. The pressure in regenerator 105 is reduced such that substantially all of the condensed high-boiling constituents are evaporated and pass out of regenerator 105 through line 106. The scavenging gas containing the high-boiling constituents can then be partially diverted through line 107 and removed from the system for use as fuel, etc. At least part of the scavenging gas from line 106 is passed through line 108 through impurity removal system 109 wherein a major portion of the undesired impurities are removed by an alternate process to the regenerator process, which operates more effectively on a gas stream containing a higher concentration of impurities.

The gas stream from the the impurity removal system 109 is passed through line 110 then through compressor 111, wherein desired pressure is attained in the gas for transmittal through line 112 into first regenerator 102 for recycle through the process.

The scavenging gas passing from line 112 into first regenerator 102 is generally not completely free of impurities.

The purified gas stream from line 103 passes into third regenerator 113 to thereby cool the regenerator 113, preferably back to the original temperature of the first regenerator 102. The purified gas stream from third regenerator 113 is then passed through line 114 where it is transmitted for use of the pure gas. In the case of coke-oven gas, wherein the pure gas stream comprises carbon monoxide, hydrogen, methane and nitrogen, this pure gas stream may be utilized, for example, as the feedstock for a hydrogen plant.

Figure 2:
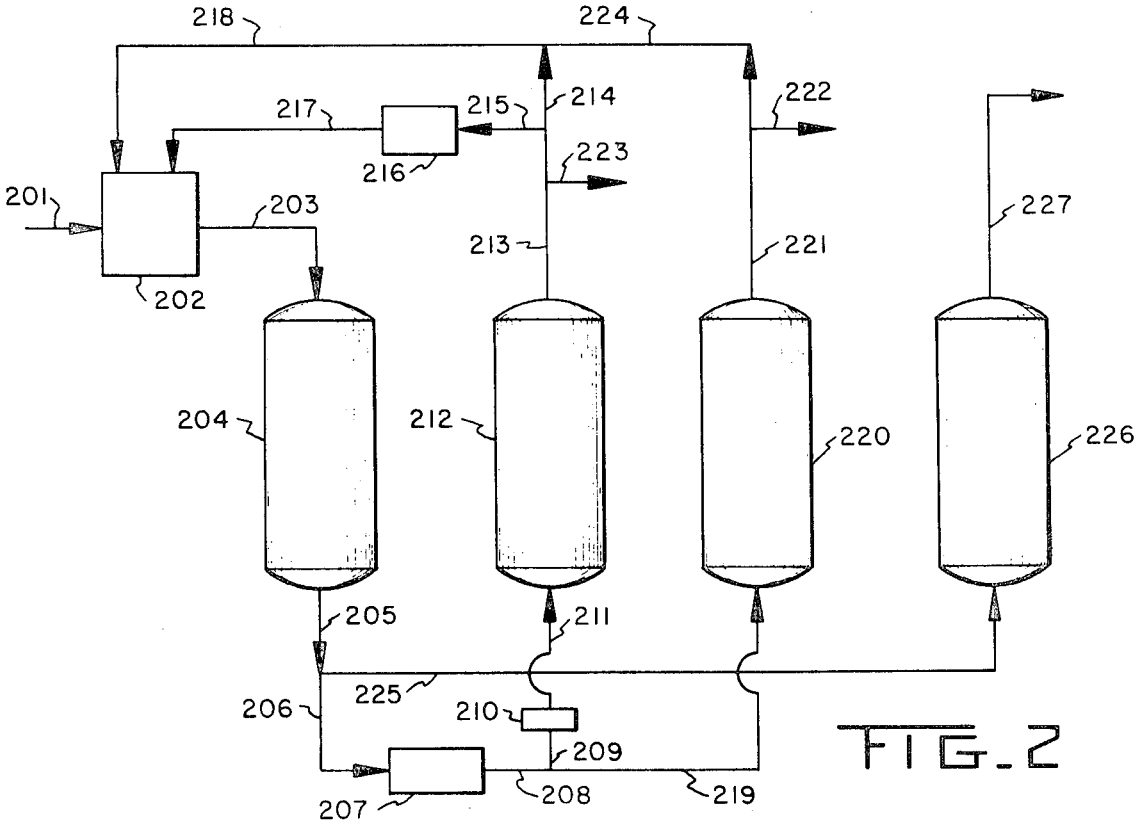
FIG. 2 shows a preferred embodiment of a flow diagram of this invention comprising four cyclical alternated regenerators.

In FIG. 2, a raw gas mixture such as might be obtained from coke-oven gases is passed through line 201 into compressor 202 where the gas is compressed to desirable pressure and then passed through line 203 into first regenerator 204 charged with a customary granular filler mass. The temperature and pressure of regenerator 204 is maintained at such a level that high-boiling constituents are condensed out in regenerator 204. The purified gas stream from regenerator 204 is passed through line 205. A portion of the purified gas stream is then passed through line 206 through expansion means 207 wherein the pressure is partially reduced and then passed through line 208. A portion of the purified gas stream from line 208 is then passed through line 209 into pressure reduction means 210 wherein pressure is further reduced and the decompressed purified gas stream is then passed through line 211 into second regenerator 212 wherein it is used as a scavenging gas to evaporate the high-boiling constituents condensed therein. The scavenging gas containing the high-boiling constituents is then passed from regenerator 212 through line 213. A portion of this gas may be passed through line 214 and 218 and back into the inlet of compressor 202 for recycle in the system. Another portion of the scavenging gas from line 213 is passed through line 215 into impurity removal means 216 for removing at least part of the undesired impurities. The scavenging gas containing a part of the impurities is passed back to compressor 202 by line 217 and then recycled through the regenerator system.

A portion of the purified gas stream from line 208 is passed through line 219 into third regenerator 220 where it is used as a scavenging gas to collect and evaporate a further portion of the high-boiling constituents that had previously been condensed in the regenerator 220. The scavenging gas from regenerator 220 is passed through line 221. A portion or all of the scavenging gas from lines 213 and 221 may be removed from the system through lines 222 or 223, so long as at least part of the scavenging gas is recycled through the regenerator system. At least a portion of the scavenging gas from line 221 may be passed through lines 224 and 218 back to the inlet of compressor 202 and then recycling this gas through the regenerator system.

Preferably the amount of gas recycled is automatically regulated by the compressor to thereby maintain a desired rate of gas flow through the various parts of the process.

A portion of the purified gas stream from line 205 is passed through line 225 into fourth regenerator 226 wherein the regenerator is cooled, preferably back to the temperature originally maintained in the first regenerator. The purified gas stream is passed from fourth regenerator 226 through line 227 for use of the purified gas stream. In the case of hydrogen, carbon monoxide, methane and nitrogen, derived from a coke-oven gas stream it is possible to utilize the purified gas stream from line 227 for its chemical values such as in a hydrogen production plant.

EXAMPLE 1

A raw gas stream derived from a light oil plant and which contains hydrogen sulfide and hydrogen cyanide is passed through a compressor to obtain a pressure in the gas stream of 35 psia. The $H_2S$ referred to herein also includes minor amounts of sulfur dioxide and other sulfur compounds. This gas is passed into a regenerator system such as described in FIG. 1, wherein the temperature at the top of first regenerator 102 is 50° F., and the temperature at the bottom of regenerator 102 is −110° F. Five weight percent of the raw gas stream is condensed on the granular particles inside of first regenerator 102. The condensed gas comprises nearly all of the hydrogen cyanide present in the original raw gas stream, plus a residual small amount of hydrogen sulfide, water and light oil. Ninety-five weight percent of a purified hydrogen sulfide gas stream leaves the bottom of the first regenerator and passes through the third regenerator 113. The pressure at the bottom of the first regenerator and at the bottom of the third regenerator is 32 psia. The third regenerator is cooled so that the top of the third regenerator reaches a temperature of about 48° F. Essentially ninety-five weight percent of purified gas leaves the top of the third regenerator 113 at a pressure of 30 psia. This is a purified $H_2S$ stream suitable for recovery of sulfur from a conventional sulfur recovery plant. A scavenger gas from an outside source comprising hydrogen, carbon monoxide, methane and nitrogen at about 10 psia is passed through line 104 into second regenerator 105, wherein substantially all of the condensed high-boiling materials previously deposited are evaporated and carried from the top of regenerator 105. The scavenging gas entering second regenerator 105 has a temperature of −120° F., and when it leaves the second regenerator 105 has a temperature of 50° F. A portion of this scavenging gas containing hydrogen sulfide is passed through a hydrogen cyanide removal means and then a compressor and recycled through the system as discussed in general in the discussion of FIG. 1.

EXAMPLE 2

Clean coke-oven gas at a temperature of 90°–100° F. and saturated with water is treated by a regenerator system such as described in FIG. 2. A pressure of 50 psia is obtained for the gas mixture by passing it through compressor 202. Ten weight percent of the initial gas stream is condensed in the first regenerator 204 leaving ninety weight percent of the gas stream as the purified gas stream leaving the bottom of the first regenerator 204. The temperature at the top of the first regenerator is 90° F. and that at the bottom of the first regenerator is −258° F. Water, light oil and acid gases make up the high-boiling constituents that condense out in the first regenerator 204. Hydrogen, methane, carbon monoxide and nitrogen make up the purified gas stream leaving the bottom of the first regenerator 204. A portion of the purified gas stream is passed through the second regenerator 212 which has had is pressure reduced from 50 psia to 2 psia. This purified gas stream acts as a scavenging gas. Approximately five weight percent of the original gas stream is used as a scavenging gas in the second regenerator. Most of the high-boiling constituents are evaporated and removed from the regenerator thereby removing approximately 15 weight percent of the original gas stream from the second regenerator. This gas stream is removed from the system for use as fuel or further treatment as described in FIG. 1. Approximately 30 weight percent of the original raw gas stream is removed from pressure reduction means 207, wherein the pressure is reduced from about 47 psia to about 23 psia, and passed into the bottom of the third regenerator 220. Thus, the third regenerator is at a pressure of about 23 psia. The scavenging gas from third regenerator 220 leaves the top of the regenerator at about 90° F. and is recycled to the compressor 202 for recycle in the system. The amount of impurities picked up from the third regenerator in the gas stream leaving the third regenerator is generally less than about one volume percent, and preferably in the parts per million range. The reason for the third regenerator to remove the final amount of impurities is to reduce the tremendous volumes of gases that would be required at lower pressures such as specified for the second regenerator. Approximately fifty-five weight percent of the original gas stream is passed as purified gas from line 205 through line 225 into the fourth regenerator, wherein cooling takes place to achieve a bottom temperature of about −258° F. and a top temperature of about 90° F. The pressure of the gas entering the bottom of the fourth regenerator 226 is at about 47 psia and at the top of this regenerator is about 45 psia. The purified gas stream leaving the fourth regenerator 226 is passed to a hydrogen plant, and generally has an impurity level less than about 0.05 percent by volume and preferably less than about 0.02 percent by volume, when water is included as an impurity.

The net effect of recycling the gas stream from the third regenerator is to obtain approximately 80–85 weight percent of the original raw gas stream as a pure gas as compared to approximately 55 weight percent in the prior art system without recycle.

The amount of gas recycled from the third regenerator 220 to the compressor 202 is varied such that the variable flow rate of coke-oven gas feeding into the compressor 202 is equalized such that the total gas stream flowing through this compressor is substantially constant in order to obtain effective operation of the compressor.

Additionally, the amount of gas recycled from the third regenerator to compressor 202 is varied in order to obtain an essentially uniform flow of purified gas leaving the system through line 227 to the hydrogen plant.

The pressure at which the regenerators can be operated varies considerably and depends upon the end results desired.

Depending upon the gas source, the composition of the initial gas mixture may vary considerably. Thus, the high-boiling constituents desired to be removed may vary from a few parts per million up to most of the gas mixture. Generally with gas from a coal conversion process such as coke-oven gas, between about 5 and about 15 percent of said compressed gas mixture comprises high-boiling constituents which are desirably removed from the stream.

The compressed gas mixture of this invention may be any mixture which can readily be separated by controlling temperature and pressure to condense a portion of the gases, and then subsequently to evaporate the condensation products. Preferably the gases comprise carbonaceous components, such as carbon monoxide, carbon dioxide or hydrocarbons. Suitable hydrocarbons are methane, ethane, propane, propylene, benzene, toluene, xylene, etc. Non-carbonaceous gases that may be part of the gas mixture include any of those found in coke oven gas, such as oxygen, nitrogen, nitrogen oxide, hydrogen cyanide, hydrogen sulfide or nitrous oxide.

When the procedure of Example 2 is followed using coke oven gas as the gas to be separated, the following Table indicates the gas compositions of the individual gases in the recycle gas stream leaving the third regenerator 220 and the product gas stream leaving the fourth regenerator 226.

TABLE

| Gas Component | Recycle Gas Leaving Third Regenerator | Product Gas Leaving Fourth Regenerator |
|---|---|---|
| Oxygen | .8%* | .8% |

TABLE-continued

| Gas Component | Recycle Gas Leaving Third Regenerator | Product Gas Leaving Fourth Regenerator |
|---|---|---|
| Methane | 29% | 29% |
| Nitrogen | 7% | 7% |
| Carbon Monoxide | 7% | 7% |
| Hydrogen | 55% | 55% |
| Benzene | Typically about 500 ppm, but up to 1000 ppm | 0 |
| Water | About 800 ppm | About 200 ppm |
| Carbon Dioxide | About 500 ppm | 25–50 ppm |
| Ethylene | About 800 ppm | 0–150 ppm |
| Hydrogen Sulfide | About 600 ppm | 0–25 ppm |

*percent by volume

I claim:

1. In a process for the purification of the low-boiling constituents of a compressed gas mixture from a variable source by cooling to low temperatures in cyclical alternated regenerators to condense high-boiling constituents of said gas mixture comprising (1) passing said gas mixture through a first regenerator from the warm end to the cold end of the same to cool said gas mixture and to condense said high-boiling constituents of said gas mixture thereby producing a purified gas stream; (2) passing large quantities of a scavenging gas which is at a lower pressure than said gas mixture in said first regenerator through a second regenerator from the cold end to the warm end of the same to clean said second regenerator and to re-evaporate said high-boiling constituents, and (3) passing at least part of said purified gas stream through a third regenerator from the cold end to the warm end of same to re-cool said third regenerator, the improvement comprising compressing and recycling at least part of said scavenging gas which has passed through said second regenerator and has thereby become contaminated with high-boiling impurities through said first regenerator from the warm end to the cold end and repeating the process as defined above.

2. Process as in claim 1 wherein said scavenging gas is obtained by expanding part of said purified gas stream, and wherein the third regenerator is cooled to the temperature of the first regenerator.

3. Process as in claim 2 wherein said compressed gas mixture is produced by passing said gas mixture through a compressor.

4. Process as in claim 3 wherein at least part of said scavenging gas is recycled to the inlet of said compressor.

5. Process as in claim 4 wherein the amount of gas recycled is automatically regulated to thereby maintain a constant amount of gas passing through said first regenerator.

6. Process as in claim 1 wherein said second regenerator comprises two separate regenerators, 2A and 2B; and wherein part of the expanded purified gas stream from said first regenerator undergoes further pressure reduction and is passed through regenerator 2A, which is kept at sufficiently low pressure to remove most of said high-boiling constituents; and wherein a different part of said expanded purified gas stream is passed through regenerator 2B, which is kept at a pressure above that of regenerator 2A and below that of the first regenerator, to thereby remove substantially all of the balance of said high boiling constituents.

7. Process as in claim 6 wherein the amount of scavenging gas recycled is varied to thereby maintain a constant amount of gas passing through said fourth regenerator.

8. Process as in claim 1 wherein said scavenging gas being recycled is combined with a variable source of gas mixture intended for said first regenerator and wherein the amount of this recycled scavenging gas is varied to thereby maintain a constant amount of gas passing through said first regenerator.

9. A process for purifying a compressed carbonaceous gas mixture from a variable source by removing certain high-boiling constituents by cooling to low temperatures in cyclical alternated regenerators to condense said high-boiling constituents comprising (1) passing said gas mixture through a first regenerator from the warm end to the cold end of said first regenerator to cool said gas mixture and to condense said high-boiling constituents of said gas mixture thereby producing a purified gas stream, (2) expanding part of said purified gas stream and passing it as a scavenging gas through a second regenerator from the cold end to the warm end of the same to clean said second regenerator and to re-evaporate most of said high-boiling constituents, (3) expanding part of said purified gas stream to a lesser level of expansion than in step (2) and passing it as a scavenger gas through a third regenerator from the cold end to the warm end of the same to clean said third regenerator and to re-evaporate additional said high-boiling constituents not previously re-evaporated in step (2), (4) passing a different part of said purified gas stream through a fourth regenerator from the cold end to the warm end of the same to re-cool said fourth regenerator, and (5) compressing and recycling at least part of said scavenging gas which has passed through the second and third regenerators and has thereby become contaminated with high boiling impurities through said first regenerator and repeating the process as defined above.

10. Process as in claim 9 wherein said purified gas stream coming from said fourth regenerator comprises hydrogen, carbon monoxide, methane, and nitrogen, and less than about 0.05 percent by volume of high boiling constituents.

11. Process as in claim 9 wherein said purified gas stream passed through said second regenerator comprises a further expansion of part of said purified gas stream expanded to pass through said third regenerator, and wherein said fourth regenerator is re-cooled to the temperature of said first regenerator.

12. Process as in claim 11 wherein said scavenging gas which has passed through said third regenerator is recycled.

13. Process as in claim 11 wherein said scavenging gas which has passed through said second regenerator is passed through a recovery system to partially recover the high-boiling constituents from the gas stream and then recycling the partially purified gas stream from said recovery system.

14. Process as in claim 11 wherein said scavenging gas which has passed through said second regenerator and said third regenerator is recycled.

15. Process as in claim 11 wherein said scavenging gas being recycled is combined with a variable source of gas mixture intended for said first regenerator and wherein the amount of this recycled scavenging gas is varied to thereby maintain a constant amount of gas passing through said first regenerator.

16. Process as in claim 11 wherein said regenerators are operated at relatively high pressures.

17. Process as in claim 11 wherein said regenerators are operated at relatively low pressures.

18. Process as in claim 11 wherein said high-boiling constituents constitutes between a few parts per million and a majority of said gas mixture entering said first regenerator.

19. Process as in claim 11 wherein between about five and about fifteen weight percent of said compressed gas mixture comprises said high-boiling constituents.

20. Process as in claim 11 wherein said gas mixture originates from a coal conversion process.

21. Process as in claim 20 wherein said gas mixture originates from a coke plant.

22. Process as in claim 9 wherein said second regenerator is depressurized prior to passing said expanded purified gas stream through the same.

23. Process as in claim 9 wherein the amount of scavenging gas recycled is varied to thereby maintain a constant amount of gas passing through said fourth regenerator.

24. Process as in claim 9 wherein said compressed gas mixture is produced by passing said gas mixture though a compressor.

25. Process as in claim 24 wherein at least part of said scavenging gas is recycled to the inlet of said compressor.

26. Process as in claim 25 wherein the amount of gas recycled is automatically regulated to thereby maintain a constant amount of gas passing through said first regenerator.

* * * * *